US005138822A

United States Patent [19]

Velge

[11] Patent Number: 5,138,822

[45] Date of Patent: Aug. 18, 1992

[54] METHOD OF PACKING EMPTY COLLAPSIBLE TUBES

[75] Inventor: Gordon O. Velge, Swarthmore, Pa.

[73] Assignee: Teledyne Industries, Inc., Chester, Pa.

[21] Appl. No.: 737,285

[22] Filed: Jul. 29, 1991

[51] Int. Cl.[5] ..... B65B 35/30; B65B 35/50; B65B 21/06; B65B 5/08

[52] U.S. Cl. ..... 53/443; 53/444; 53/445; 53/447; 53/475

[58] Field of Search ..... 53/444, 447, 475, 148, 53/443, 452, 458, 467, 471, 485, 488, 478, 445

[56] References Cited

U.S. PATENT DOCUMENTS 410,553 9/1889 Lang ..... 53/444 X
1,993,216 3/1935 Marshall .
3,279,145 10/1966 Williamson ..... 53/475
3,283,893 11/1966 Durocher et al. ..... 53/444 X
3,363,823 1/1968 Paige et al. ..... 229/15
3,562,999 2/1971 Barbedienne ..... 53/30
3,596,781 8/1971 Burton ..... 214/10.5
3,747,751 7/1973 Miller et al. ..... 206/65
3,986,611 10/1976 Dreher ..... 206/386
4,250,687 2/1981 Lueneberg et al. ..... 53/447 X
4,265,184 5/1981 Cox ..... 108/55.1
4,565,289 1/1986 Lesueur ..... 53/444 X
4,927,075 5/1990 Lisiecki ..... 53/478 X

*Primary Examiner*—Horace M. Culver
*Attorney, Agent, or Firm*—Eugene Chovanes

[57] ABSTRACT

A method of packing empty collapsible tubes for shipment to the filler and sealer of the tubes, wherein the ten usually used diameter tubes can be packed into one of two standard size boxes.

3 Claims, 5 Drawing Sheets

| TUBE DIAMETER | 16 IN. X 10 3/4 IN. BOX $B_1$ | 16 IN X 10 IN. BOX-$B_2$ | NUMBER OF TUBES/BOX |
|---|---|---|---|
| $T_1$ = 1/2 IN. | PARTITIONED<br>UN-PARTITIONED | | 425<br>756 |
| $T_2$ = 5/8 IN. | PARTITIONED | UN-PARTITIONED | 280<br>450 |
| $T_3$ = 3/4 IN. | PARTITIONED | UN-PARTITIONED | 216<br>308 |
| $T_4$ = 7/8 IN. | UN-PARTITIONED | PARTITIONED | 245<br>150 |
| $T_5$ = 1 IN. | | PARTITIONED<br>UN-PARTITIONED | 126<br>171 |
| $T_6$ = 1 1/8 IN. | | PARTITIONED<br>UN-PARTITIONED | 96<br>135 |
| $T_7$ = 1 3/16 IN. | PARTITIONED<br>UN-PARTITIONED | | 96<br>130 |
| $T_8$ = 1 1/4 IN. | | PARTITIONED<br>UN-PARTITIONED | 77<br>108 |
| $T_9$ = 1 3/8 IN. | PARTITIONED | UN-PARTITIONED | 70<br>88 |
| $T_{10}$ = 1 1/2 IN. | UN-PARTITIONED | PARTITIONED | 60<br>80 |

FIG. 3.

| TUBE DIAMETER | 16 IN. X 10 3/4 IN. BOX $B_1$ | 16 IN X 10 IN. BOX-$B_2$ | NUMBER OF TUBES/BOX |
|---|---|---|---|
| $T_1$ = 1/2 IN. | PARTITIONED<br>UN-PARTITIONED | | 425<br>756 |
| $T_2$ = 5/8 IN. | PARTITIONED | UN-PARTITIONED | 280<br>450 |
| $T_3$ = 3/4 IN. | PARTITIONED | UN-PARTITIONED | 216<br>308 |
| $T_4$ = 7/8 IN. | UN-PARTITIONED | PARTITIONED | 245<br>150 |
| $T_5$ = 1 IN. | | PARTITIONED<br>UN-PARTITIONED | 126<br>171 |
| $T_6$ = 1 1/8 IN. | | PARTITIONED<br>UN-PARTITIONED | 96<br>135 |
| $T_7$ = 1 3/16 IN. | PARTITIONED<br>UN-PARTITIONED | | 96<br>130 |
| $T_8$ = 1 1/4 IN. | | PARTITIONED<br>UN-PARTITIONED | 77<br>108 |
| $T_9$ = 1 3/8 IN. | PARTITIONED | UN-PARTITIONED | 70<br>88 |
| $T_{10}$ = 1 1/2 IN. | UN-PARTITIONED | PARTITIONED | 60<br>80 |

FIG. 4. ($T_1$ = 1/2 IN. DIA.)

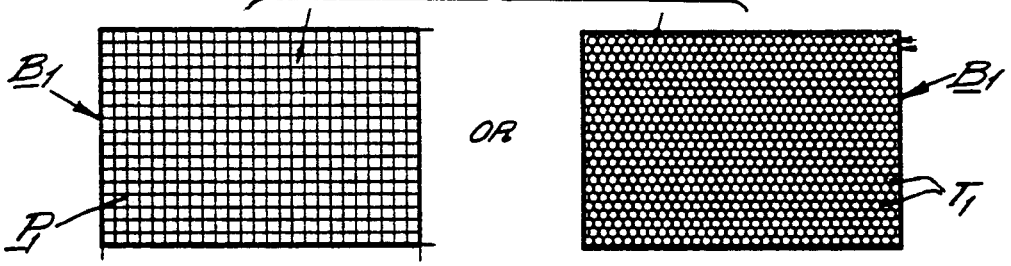

FIG. 5. ($T_2$ = 5/8 IN. DIA.)

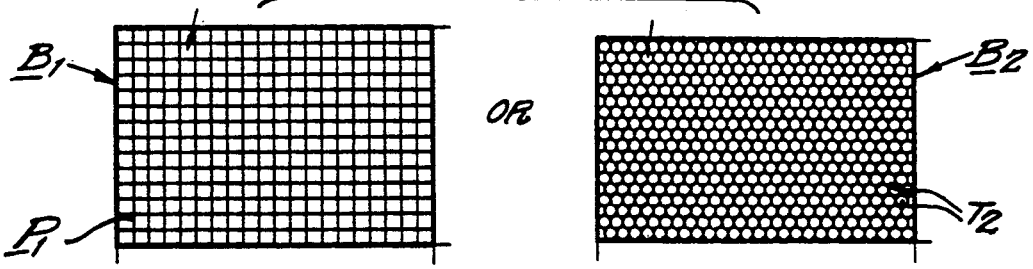

FIG. 6. ($T_3 = \frac{3}{4}$ IN. DIA.)
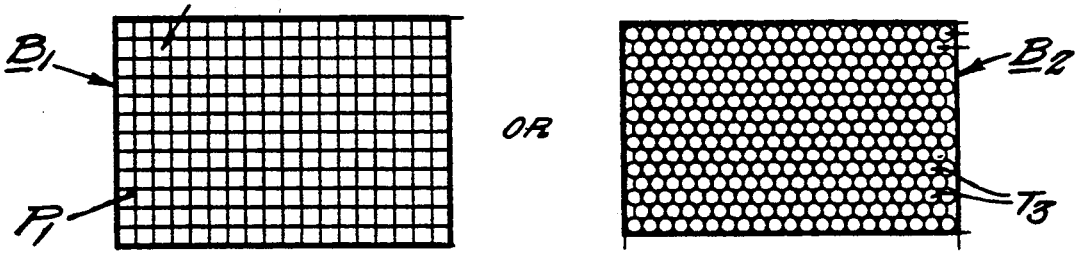
FIG. 7. ($T_4 = \frac{7}{8}$ IN. DIA.)
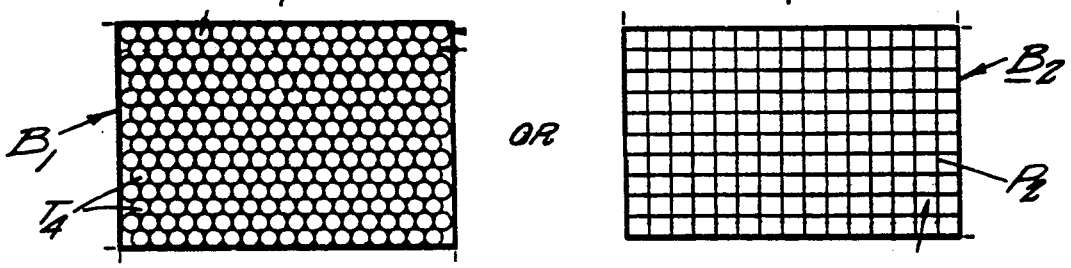
FIG. 8. ($T_5 = 1$ IN. DIA.)
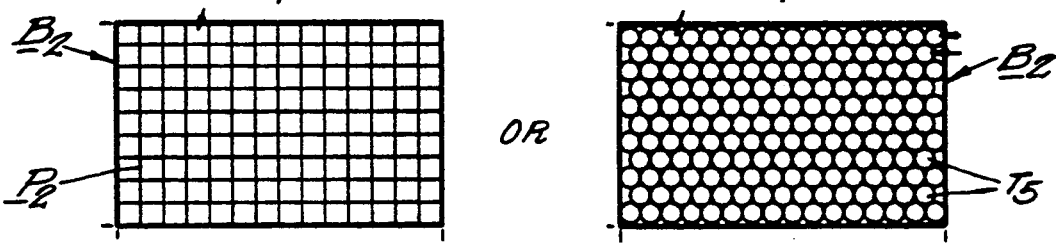
FIG. 9. ($T_6 = 1\frac{1}{8}$ IN. DIA.)
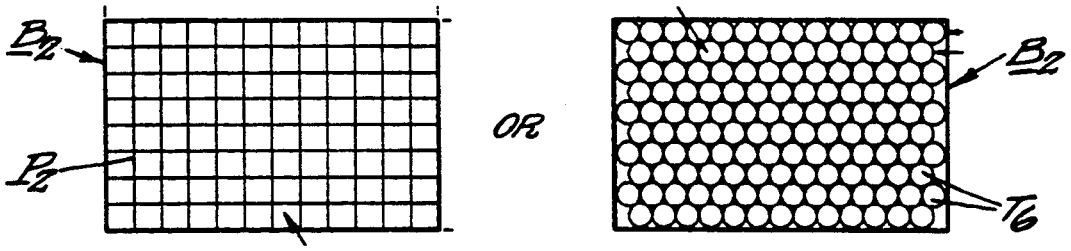
FIG. 10. ($T_7 = 1\frac{3}{16}$ DIA.)
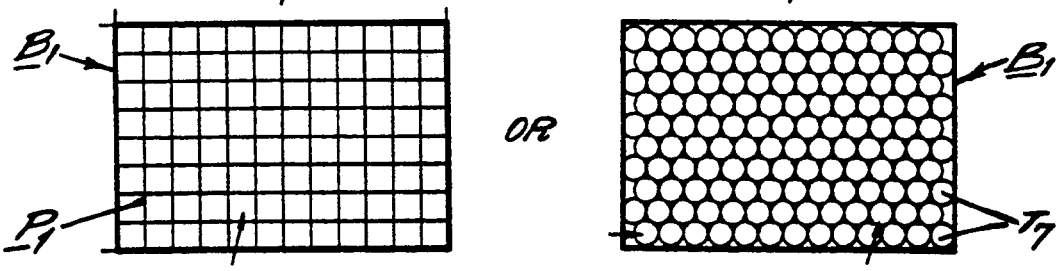

Fig. 11. ($T_8 = 1\frac{1}{4}$ IN.)
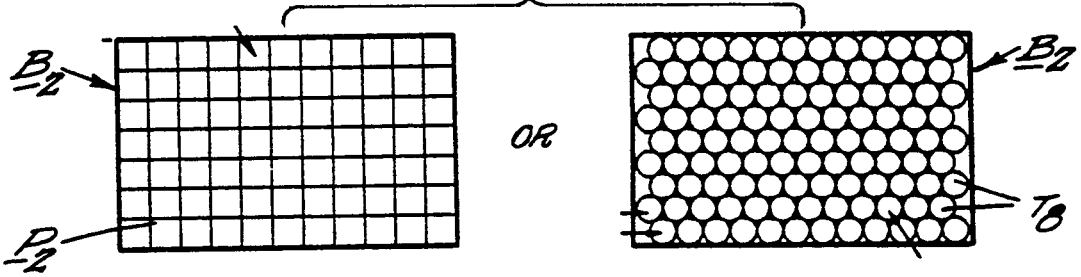
Fig. 12. ($T_9 = 1\frac{3}{8}$ IN. DIA.)
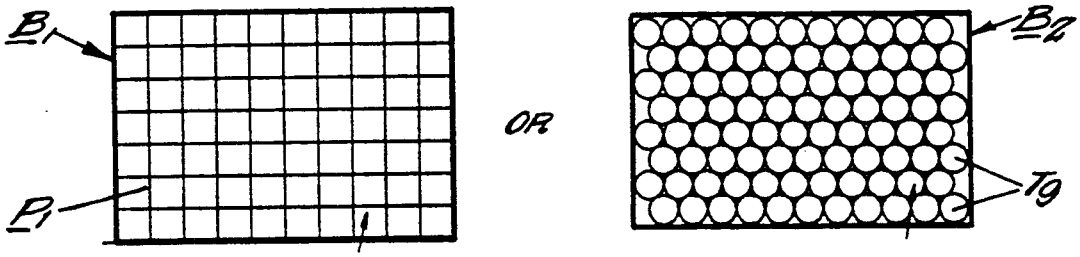
Fig. 13. ($T_{10} = 1\frac{1}{2}$ IN. DIA.)
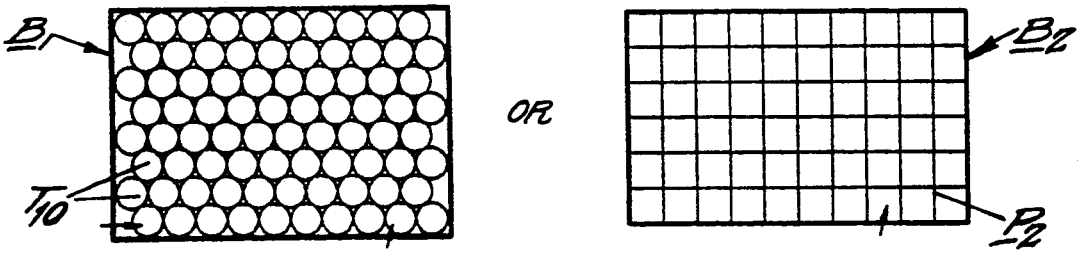

METHOD OF PACKING EMPTY COLLAPSIBLE TUBES

BACKGROUND OF THE INVENTION

1. Field of the Invention

This invention relates to packing in boxes, for shipping, of empty collapsible tubes by the tube manufacturer to the product manufacturer who fills and seals the tubes.

2. Background Art

Collapsible tubes are used to contain and dispense fluids wherein the wall of the tube is deformed to squeeze out the fluid. Such tubes are made by a tube manufacturer and then shipped, empty, with the bottom open and up for filling and sealing by the product manufacturer. The tubes are shipped with the closure caps attached. The wall material is in some instances of tin, and in other instances of aluminum or even laminates. Such material is easily deformed so that the empty tubes must be carefully packed for, and protected during, shipment. Also, particularly in the case of pharmaceuticals, the tube must be kept perfectly clean in packing, shipping, and unpacking for filling, to prevent contaminating the contents.

Thus, the packing and shipping of empty collapsible tubes is of utmost importance to a tube manufacturer and much effort and expense is devoted to this phase of a tube manufacturer's operations.

The tubes are shipped in either partitioned boxes or partitionless boxes.

The tubes are in most instances in one of ten standard size outside diameters (O.D.'s) that range from ½" to 1½" in ½" increments. There are specialty orders for other sizes, but the standard sizes constitute the vast bulk of the business.

When shipped in partitioned boxes, separate small compartments formed by internesting dividers give a separate space for each tube, with accompanying protection.

In a partitionless box, the tubes are in contact with one another and are arranged vertically in the box, side by side. The tubes abut one another in such side by side relationship to form a honeycomb effect which gives a strong measure of strength and protection against damage to the tubes. It is critical that the tubes be not too tightly pressed against one another to avoid, among other things, damage in packing, since they are either hand-packed or machine-packed by placement of tubes so that they extend vertically in the box, one against another, when the box extends horizontally. Hence, the box must of a proper size for the number of tubes packed.

Most of the shipping is done in partitionless boxes, thus eliminating the cost of the partitions and permitting more tubes to be shipped per box. The tubes are packed in a partitionless box by hand or by machine. In packing a partitionless box by hand, the tubes are either inserted into the box vertically, the box extending horizontally, or, in the alternative, the box is at an incline, for instance 45°, and the tubes are laid at an angle to obtain the benefit of both side nesting and bottom nesting into the box.

In one form of machine packing of a partitionless box, the box extends vertically and a given number of tubes in a horizontal row, for instance 31, which would occupy the length of the box, are simultaneously placed into the box horizontally by a movable tray which abuts the top of the tubes. The machine is programmed to lower the box to receive successive, horizontal rows of tubes. After the box is fully packed, it is rotated into a horizontal position wherein the tubes extend vertically, inverted, with the open bottoms extending across the top of the box.

In either form of packing, the end desired result is a compact arrangement of vertically extending tubes resting with the heads and caps thereon at the bottom of the box and open bottoms of the tubes extending across the top of the box. The vertical dimension of the box depends on the height of the tube. For instance, in a tube having a 2½" overall length including the cap, the vertical dimensions of the box would be such as to permit the tubes to be contained vertically within the box and cover.

In a procedure used in Europe, the open ends of the tubes extend above the top of the box, creating a columned effect. The cover rests right on top of the tubes.

In the United States, the more general policy is to use a box that extends above the tubes, for instance ⅛", so there is some vertical play which is not harmful since the tubes are relatively restrained sideways, so that virtually no jumbling occurs. A problem with "play" vertically of the tubes is that they have a tendency to move longitudinally, one with respect to another, or rotate axially, one with respect to another, so that some rubbing or marring of the tube surface and decoration occurs.

To hold the packed tubes properly, boxes of the prior art for packing and shipping tubes came in many horizontal dimensions; that is, length and width. These were determined by the following:

1) In some instances, the box dimension was based on a customer's request for a box to contain a certain number of tubes. For instance, a customer might want a box for a gross (144) and the box would be designed to hold, for instance, 12 rows, 12 across. The outside dimension (O.D.) of the tube would be taken into consideration, and a box simply designed for that number of tubes, taking into consideration the necessary spacing needed for the procedure of packing as discussed above, and the necessary closeness to provide proper protection for the tubes, as again discussed above. The box dimension, hence, was calculated from both the tube size and, from past experience, the necessary clearance and the necessary tightness.

Again, where a partition was used as was often the case with a 12×12 gross box, the thickness of the partition was calculated into the box dimensions.

2) In other instances, the box dimension was based on a number of tubes which was, in effect, arbitrary. For instance, a customer would determine that a certain size box would fit, for example, a cassette in its filling machine and, hence, order a number of tubes and that size box, based on this consideration.

3) In still another instance, the skid on which the filled boxes are packed and secured, as by shrink wrapping, determined the desired size box and the amount per trailer of these boxes.

4) Still another consideration might be the size of the sterilization chamber when such is used. (Sometimes the customer sterilizes the tubes before filling.) In that instance, a box size is selected which is compatible with the sterilization chamber, and then the tubes are packed accordingly.

It will be seen from the above examples that the box size is determined in such a way that there is virtually an infinite number of sizes which must be provided. Bearing in mind that the above examples must also compensate for the ten various size standard outside diameters (O.D.'s), it will be seen that, for instance, where a box is determined by a gross (144) number, there would have to be ten different size boxes for the ten relatively standard size tubes, referring to the horizontal dimension of the boxes. Where a box size is determined by the pallet capacity and the trailer capacity, again there must be virtually a specific box size for every different size of tube.

As shown in the above examples, the result is that tube manufacturers must have an enormous number of box sizes as a possibility and, practically, there has evolved this necessity for an inventory of a great number of box sizes which must be provided by the tube manufacturer. The provision and use of such an inventory is expensive.

SUMMARY OF THE PRESENT INVENTION

The present invention is for a method, and boxes used in the method, wherein only two different size boxes, having the same length and a slightly different width, are needed to pack and ship any of the ten standard sizes of tubes (O.D.) in a satisfactory manner. The height of the two different size boxes will vary to compensate for the overall height of the unfilled, open bottom, collapsible tubes.

The tubes are packed with or without partitions in the box, in either of the prior art methods; that is, by hand or by machine. The tubes are packed and remain packed in a manner wherein there is neither excess space around the tubes when the box is fully packed, nor is there undue jamming or tightness, both during packing and when fully packed and during shipment.

The length and width of one box ($B_1$) is 16"×10 ¾" and the corresponding dimensions of the second box (B2) are 16"×10".

In the invention, standard tubes (T) of a given diameter (O.D.) are placed in either a $B_1$ or a $B_2$ box, based on whether a partitioned or partitionless box is desired. The box selection is based on a predetermined calculation which determines the number of tubes, and the disposition of such tubes within the box.

The tubes are packed by machine or by hand into the designated box ($B_1$ or $B_2$), as in the prior art. The boxes are then covered and stacked in certain fashion in layers on either a 40"×48" skid $S_1$ or a 42"×42" skid $S_2$.

The invention is such that a box repetitively, when filled, either manually or mechanically, contains the exact same number of tubes of a given size (N) in the exact configuration.

The boxes with partitions have spaces in a grid pattern, as in the prior art.

When packed without partitions, the configuration of the tubes is in the form of staggered straight rows, one row next to and in contact with another. The straight rows of tubes are alternately staggered one-half diameter back and forth, transversely across the box. To the eye in a plan view from above, the tubes appear in diagonal rows which are "X" in form. The nesting is such that, if the box is turned sideways, one tube rests on two tubes below, in the manner that pipes are stacked wherein the natural curve of the pipe is used to support the pipe above or the pipe alongside. In trigonometry, the centers of three adjacent pipes would form a triangle having equal angles of 60°.

BRIEF DESCRIPTION OF THE DRAWINGS

FIG. 3 is a chart used to determine which box, of two boxes, to choose when packing tubes of a given diameter and how many tubes the box will hold in a secure manner, either with a partition or without.

FIGS. 4 through 13 are schematic plan views, illustrating the physical arrangement of the fragile collapsible tubes as packed in the two standard boxes, based on information shown in FIG. 3, the various arrangements being the most secure for the easily damaged tubes.

DETAILED DESCRIPTION OF THE INVENTION

Figure 1:
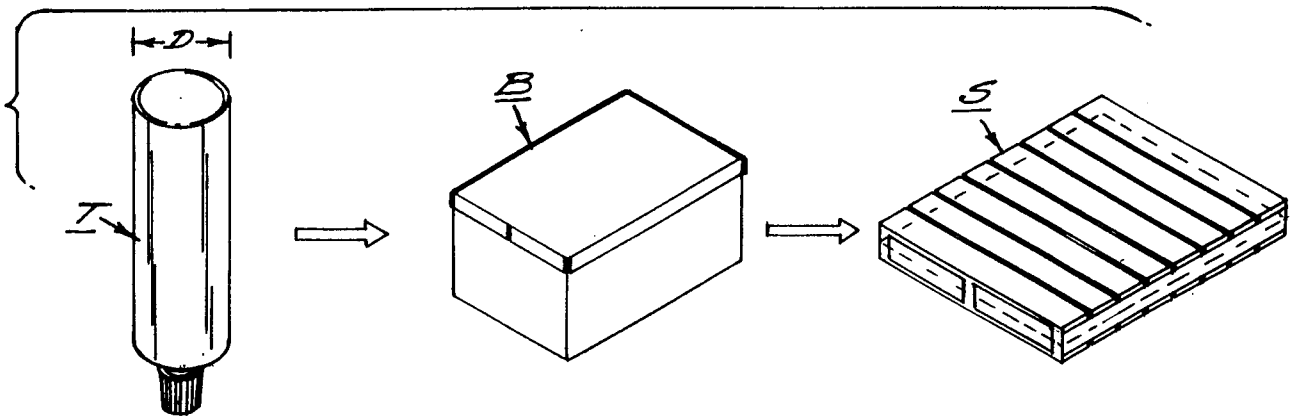
FIG. 1 is a schematic flow diagram of the components in the method of boxing and skid packing of collapsible tubes, in accordance with the invention.

In FIG. 1, there is shown an inverted empty collapsible tube T, having a curved deformable sidewall 21, and open bottom 22, and a cap closure 23. A plurality of tubes T are shipped in a box B by arranging the tubes vertically in abutting relationship, with or without partitions. A plurality of boxes B are loaded on a pallet or skid S in a plurality of horizontal layers. The boxes can be secured on the skid by shrink-wrapping with plastic sheets, or by banding with metal or plastic bands, as known in the art.

The tubes T are generally of ten standard outside diameters (O.D.'s) which are designated $T_1$, $T_2$, $T_3$, etc. for each of the standard outside diameters (O.D.'s). The O.D.'s for the respective tube designations are shown in the chart of FIG. 3 and range from ½" to 1½".

In accordance with the invention, only two size boxes, $B_1$ and $B_2$, of different horizontal dimensions; that is, length and width, are used. The height of the box will vary with the height of the empty collapsible tubes and can be readily provided with the two size boxes, where size relates to the respective width and length.

Box $B_1$ is of a 10" width by a 16" length. Box $B_2$ is of a 10¾" width by a 16" length.

Figure 2:
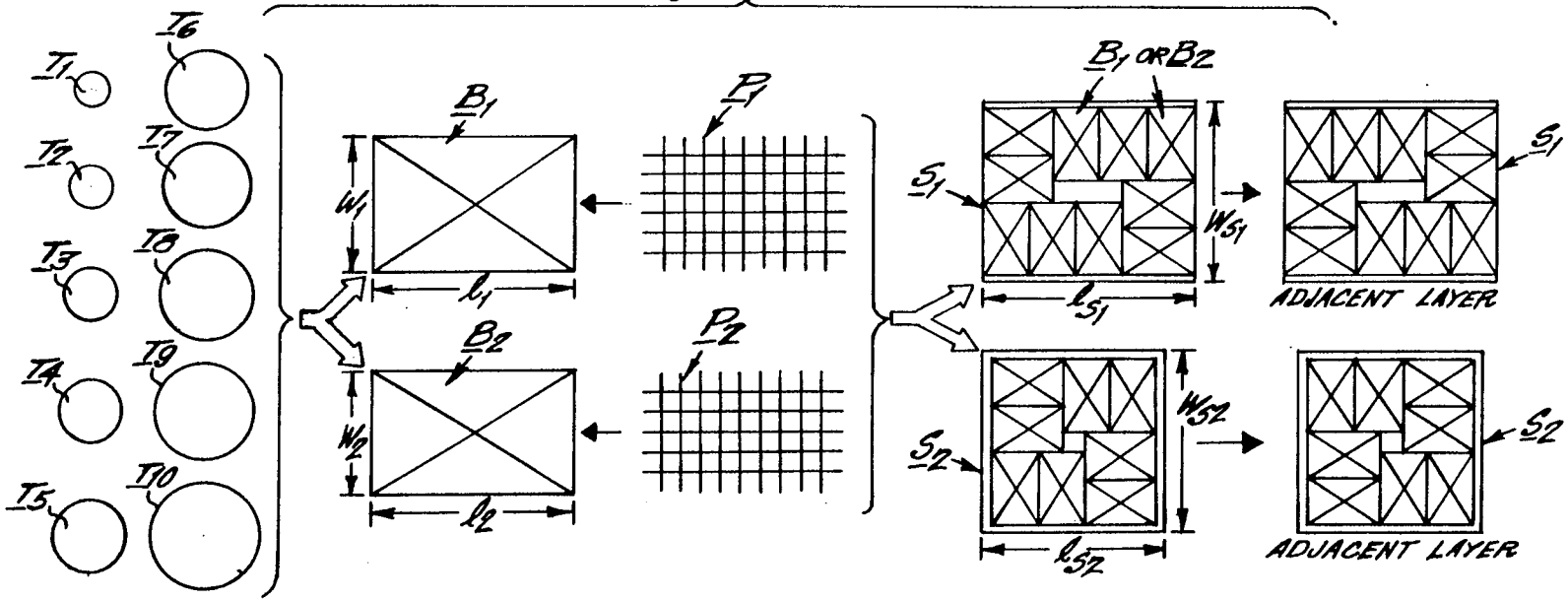
FIG. 2 is a schematic plan and flow diagram comprising all the components involved in the present method of packing and skid loading of fragile, collapsible tubes, in sequential order.

As shown in a flow diagram in FIG. 2, the tube diameter is first chosen from the ten standard diameters (O.D.'s) $T_1$ through $T_{10}$, inclusive. The numbered value of the different tube diameters is shown in FIG. 3.

It is then determined whether a partitioned or partitionless box is desired. As set forth in the background of this invention, partitioned boxes have less capacity than partitionless boxes, since the partition occupies space. However, in a partitioned box, a separate protective compartment is provided for each tube. The positioned boxes are generally harder to load than the partitionless boxes, and introduce the risk of contamination in the tubes from fibers separating from the partition. Although it is believed the invention will be particularly used with partitionless boxes, it will be seen that it can be used with partitions $P_1$ and $P_2$ by simply inserting the partitions $P_1$ and $P_2$ into the boxes when desired, as shown in the flow diagram of FIG. 2. The partitions $P_1$ and $P_2$ which fit into boxes $B_1$ and $B_2$ are simply internesting cardboard or plastic dividers, well known in the prior art.

After determining the tube diameter of the tubes T to be packed, and whether the tubes T are to be packed in a partitioned or a partitionless box, a box $B_1$ or $B_2$ is selected for packing based on the information set forth in FIG. 3. The number of tubes T to be packed in each box $B_1$ or $B_2$ is also determined from the information in FIG. 3. The number of tubes per box (N) is shown in the right-hand column.

After the box selection is made, the tubes are loaded into the boxes.

The specific arrangement of the partitions $P_1$ and $P_2$ in a partitioned box $B_1$ or B2, or the tubes in a partitionless box $B_1$ or $B_2$, is shown in plan view in FIGS. 4 through 13 inclusive.

For instance, there is shown in FIG. 4 the arrangement in a packed box $B_1$ of tubes $T_1$ which have a ½" outside diameter (O.D.). In a partitioned box $B_1$, as shown at the left of FIG. 4, partition $P_1$ conforms to the length and width of the box (16"×10¾") and extends in grid fashion to form 425 spaces or compartments which receive in close fit 425 tubes T, one in each space. There are 17 spaces extending across the width of the box and 25 spaces along the length.

Should a partitionless box $B_2$ be desired to pack tubes $T_1$, 756 tubes are packed in as seen in plan view in the right-hand section of FIG. 4. It will be seen that the first row across the bottom as seen in FIG. 4 will have 32 tubes which will fit snuggly from the left wall to the right wall. The next row or layer of tubes upward (the next to bottom row) will have one tube less in that the tube will naturally fit in the contour between the tubes of the bottom row. As can be seen, there will be a ½" tube diameter space at each side of this row, so there will be a total of 31 tubes in this row. The next upward row as depicted in FIG. 4 will again have 32 tubes since the tubes will lie, relative to the other tubes, in the manner of the bottom row. The rows will thus alternate in number between 32 and 31, slightly staggered or offset, for a total of 24 rows, with the topmost row having 31 tubes. The box $B_1$ will thus contain 756 tubes.

FIGS. 5 through 13 accurately represent loading in boxes $B_1$ or $B_2$ for the respective $T_2$ through $T_{10}$.

As seen in FIG. 2, after the boxes B are packed, they are then loaded on Skid $S_1$ or $S_2$, depending on which of these standard skids are prepared, available, or customarily used. Boxes $B_1$ or $B_2$ can be loaded and arranged equally well on either $S_1$ or $S_2$.

More specifically, as seen in FIG. 2, the boxes are arranged on either of standard size skids; namely, a first sized skid $S_1$ or a second size skid $S_2$. $S_1$ is a 40"×48" skid, and $S_2$ is a 42"×42" skid.

In loading the lowermost, or first layer, the boxes are arranged as shown in plan view. In loading the next upward adjacent layer, the boxes are arranged as shown in the figure so labeled. A suitable number of layers of boxes are loaded on the skid to a height convenient for transport. The entire skid of boxes is shrink-wrapped with a stretchable plastic in the prior art manner, whereby the entire load becomes compact and relatively integral. The skid is then moved by forklift means or other suitable power to a transport truck and then to the product manufacturer for unpacking, filling of the tubes, and sealing. The tubes T themselves, the boxes B as packed, and the loaded and wrapped skids S provide for a safe and clean transport and handling of the relatively fragile and deformable, empty, open, collapsible tubes.

The skids $S_1$ and $S_2$ are loaded in exactly the same way whether or not the boxes are $B_1$ or $B_2$. It should be noted from the chart of FIG. 3 that the only dimension difference between the boxes is ¾" in the width; the length of both boxes being 16". The most that any given overall dimension on a loaded pallet will vary, according to the pallet loading shown, will be 2½", which is completely acceptable on either $S_1$ or $S_2$.

I claim:

1. The method of packing for shipping a given number (N) of open empty collapsible tubes (T) having one of the following outside diameters (O.D.'s):

$T_1$=½"
$T_2$=⅝"
$T_3$=¾"
$T_4$=⅞"
$T_5$=1"
$T_6$=1⅛"
$T_7$=1 3/16"
$T_8$=1¼"
$T_9$=1⅜"
$T_{10}$=1½"

in either a box ($B_1$) having a length of 16" and a width of 10¾", or box ($B_2$) having a length of 16" and a width of 10", with or without partitions (P) in the box, wherein the tubes T will be in the same relative position for a given tube diameter and a given box size with partitions P or a given box size without partitions P, comprising (1) determining the tube diameter $T_1$ through $T_{10}$ of the tubes T to be packed;

(2) determining whether the tubes T are to be packed in a partitioned or a partitionless box;

(3) selecting a box $B_1$ or $B_2$, based on steps 1 and 2 above, and determining the number N of tubes T to be packed in the box, based on the following:

| TUBE DIAMETER | 16 IN. × 10¾ IN. BOX $B_1$ | 16 IN. × 10 IN. BOX $B_2$ | NUMBER OF TUBES/ BOX |
|---|---|---|---|
| $T_1$ = ½ IN. | PARTITIONED | | 425 |
| | UN-PARTITIONED | | 756 |
| $T_2$ = ⅝ IN. | PARTITIONED | | 280 |
| | | UN-PARTITIONED | 450 |
| $T_3$ = ¾ IN. | PARTITIONED | | 716 |
| | | UN-PARTITIONED | 308 |
| $T_4$ = ⅞ IN. | UN-PARTITIONED | | 245 |
| | | PARTITIONED | 150 |
| $T_5$ = 1 IN. | | PARTITIONED | 126 |
| | | UN-PARTITIONED | 171 |
| $T_6$ = 1⅛ IN. | | PARTITIONED | 96 |
| | | UN-PARTITIONED | 135 |
| $T_7$ = 1 3/16 IN. | PARTITIONED | | 96 |
| | UN- | | 130 |

-continued

| TUBE DIAMETER | 16 IN. × 10¾ IN. BOX $B_1$ | 16 IN. × 10 IN. BOX $B_2$ | NUMBER OF TUBES/ BOX |
|---|---|---|---|
| | PARTITIONED | | |
| $T_8$ = 1¼ IN. | | PARTITIONED | 77 |
| | | UN-PARTITIONED | 108 |
| $T_9$ = 1⅜ IN. | PARTITIONED | | 70 |
| | | UN-PARTITIONED | 88 |
| $T_{10}$ = 1½ IN. | | PARTITIONED | 60 |
| | UN-PARTITIONED | | 80 |

and (4) packing the number N of tubes T into the selected box (B).

Figure 14:
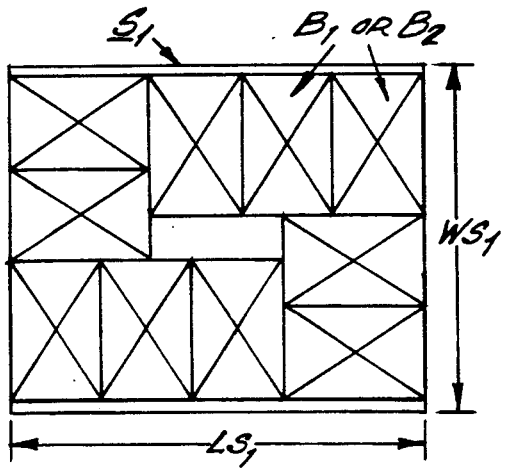
FIG. 14 is a fragmentary portion of FIG. 2 showing a plan view of boxes loaded on a skid in accordance with the invention.
Figure 15:
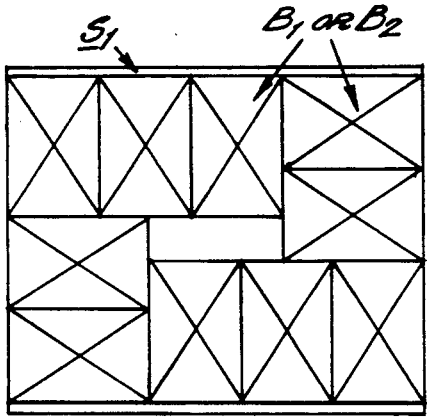
FIG. 15 is a fragmentary portion of FIG. 2 showing a plan view of boxes loaded on a skid, in accordance with the invention.

2. The method of claim 1 further comprising loading said boxes $B_1$ or $B_2$ on a skid $S_1$ having a length $LS_1$ of 48" and a width $WS_1$ of 40", comprising arranging a first layer of boxes on the skid as shown in FIG. 14, and arranging an adjacent layer of boxes on the skid as shown in FIG. 15.

Figure 16:
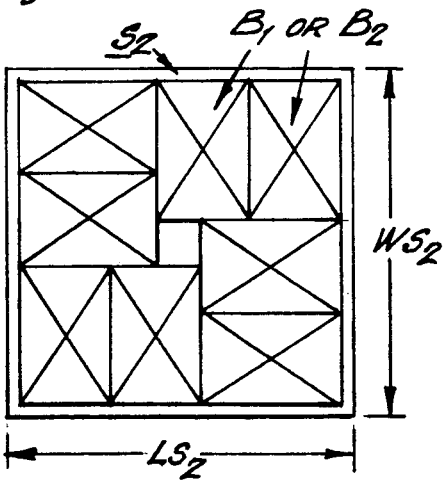
FIG. 16 is a fragmentary portion of FIG. 2 showing a plan view of boxes loaded on a skid in accordance with the invention.
Figure 17:
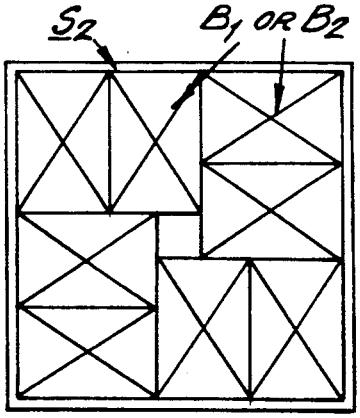
FIG. 17 is a fragmentary portion of FIG. 2 showing a plan view of boxes loaded on a skid in accordance with the invention.

3. The method of claim 1 further comprising loading said boxes $B_1$ or $B_2$ on a skid $S_2$ having a length $LS_2$ of 42" and a width $WS_2$ of 42", comprising arranging a first layer of boxes on the skid as shown in FIG. 16 and arranging an adjacent layer of boxes on the skid as shown in FIG. 17.

* * * * *